US011282456B2

(12) United States Patent
Piao et al.

(10) Patent No.: US 11,282,456 B2
(45) Date of Patent: Mar. 22, 2022

(54) PIXEL SENSING DEVICE AND PANEL DRIVING DEVICE FOR SENSING CHARACTERISTICS OF PIXELS

(71) Applicant: SILICON WORKS CO., LTD., Daejeon (KR)

(72) Inventors: Taiming Piao, Daejeon (KR); Young Bok Kim, Daejeon (KR); Won Kim, Daejeon (KR); Byeon Cheol Lee, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/124,202

(22) Filed: Dec. 16, 2020

(65) Prior Publication Data

US 2021/0193039 A1 Jun. 24, 2021

(30) Foreign Application Priority Data

Dec. 23, 2019 (KR) ..... 10-2019-0172592

(51) Int. Cl.
*G09G 3/3241* (2016.01)
*G09G 3/3291* (2016.01)
*G09G 3/3233* (2016.01)

(52) U.S. Cl.
CPC ..... *G09G 3/3241* (2013.01); *G09G 3/3291* (2013.01); *G09G 3/3233* (2013.01); *G09G 2310/027* (2013.01); *G09G 2320/0295* (2013.01); *G09G 2320/045* (2013.01)

(58) Field of Classification Search
CPC .. G09G 3/3241; G09G 3/3291; G09G 3/3233; G09G 2310/027; G09G 2320/0295; G09G 2320/045
See application file for complete search history.

(56) References Cited

U.S. PATENT DOCUMENTS

| | | | | |
|---|---|---|---|---|
| 7,719,497 | B2 * | 5/2010 | Cho | G09G 3/3283 345/82 |
| 9,424,770 | B2 * | 8/2016 | Kim | G09G 3/3233 |
| 9,721,504 | B2 * | 8/2017 | Kim | G09G 3/3233 |
| 9,830,857 | B2 * | 11/2017 | Chaji | G09G 3/3233 |
| 9,978,969 | B2 * | 5/2018 | Shin | G09G 3/3291 |
| 10,565,937 | B2 * | 2/2020 | Hwang | G09G 3/3291 |
| 10,627,436 | B2 * | 4/2020 | Chang | H03K 17/962 |
| 10,957,251 | B2 * | 3/2021 | Hwang | G09G 3/3275 |
| 11,158,259 | B2 * | 10/2021 | Wang | G09G 3/3275 |
| 2007/0139311 | A1 * | 6/2007 | Cho | G09G 3/3233 345/76 |
| 2014/0152642 | A1 * | 6/2014 | Kim | G09G 3/3208 345/212 |
| 2015/0009204 | A1 * | 1/2015 | Chaji | G09G 3/3233 345/214 |

(Continued)

FOREIGN PATENT DOCUMENTS

| | | |
|---|---|---|
| CN | 107633815 B | 2/2020 |
| CN | 108615491 B | 8/2020 |
| KR | 10-2016-0069922 A | 6/2016 |

*Primary Examiner* — Michael J Jansen, II
(74) *Attorney, Agent, or Firm* — Fenwick & West LLP

(57) ABSTRACT

The present disclosure provides, in a pixel sensing, a technology in which a parasitic impedance formed in a sensing line does not affect an integrating circuit using a current mirror circuit coupled with an operational amplifier.

14 Claims, 6 Drawing Sheets

(56) References Cited

U.S. PATENT DOCUMENTS

| | | | | |
|---|---|---|---|---|
| 2016/0163261 | A1* | 6/2016 | Kim | G09G 3/3225<br>345/205 |
| 2018/0013085 | A1* | 1/2018 | Shin | G09G 3/3291 |
| 2018/0166020 | A1* | 6/2018 | Hwang | G09G 3/3233 |
| 2018/0172744 | A1* | 6/2018 | Chang | H03K 17/962 |
| 2020/0013333 | A1* | 1/2020 | Hwang | G09G 3/3233 |
| 2021/0049962 | A1* | 2/2021 | Wang | G09G 3/3275 |
| 2021/0158731 | A1* | 5/2021 | Hu | G09G 3/3233 |
| 2021/0193039 | A1* | 6/2021 | Piao | G09G 3/3241 |
| 2021/0193056 | A1* | 6/2021 | Piao | G09G 3/3275 |

* cited by examiner

PIXEL SENSING DEVICE AND PANEL DRIVING DEVICE FOR SENSING CHARACTERISTICS OF PIXELS

CROSS REFERENCE TO RELATED APPLICATION

This application claims priority from Republic of Korea Patent Application No. 10-2019-0172592, filed on Dec. 23, 2019, which is hereby incorporated by reference in its entirety.

BACKGROUND

1. Field of Technology

The present disclosure relates to a pixel sensing technology, more particularly, to a technology for improving performance of a pixel sensing circuit.

2. Description of the Prior Art

A display device comprises a source driver for driving pixels disposed on a panel.

A source driver determines data voltages according to image data and supplies these data voltages to pixels to control the brightness of each pixel.

Here, even when the same data voltage is supplied, the brightness of each pixel varies depending on characteristics of each pixel. For example, a pixel comprises a driving transistor and when a threshold voltage of the driving transistor is changed, the brightness of the pixel is changed even if the same data voltage is supplied to the pixel. If a source driver does not reflect such characteristic changes of pixels, pixels would be driven at an undesired brightness, and this may cause a degradation of image quality.

To be concrete, characteristics of a pixel vary depending on time or the pixel's surrounding environment. Nevertheless, if a source driver supplies data voltages without reflecting such varied characteristics of pixels, this may cause a degradation of image quality, for example, burn-in.

In order to solve such a problem of degradation of image quality, a display device may comprise a pixel sensing device for sensing characteristics of pixels.

A pixel sensing device may receive sensing signals for pixels through sensing lines respectively connected with the pixels. The pixel sensing device converts the sensing signals into sensing data and transmits the sensing data to a timing controller which identifies characteristics of the respective pixels using the sensing data. The timing controller may compensate image data by reflecting characteristics of the pixels to alleviate the degradation of image quality due to differences among pixels.

A pixel sensing device generally uses integrated circuits for sensing characteristic currents of pixels. A pixel sensing device uses an analog-digital converting circuit to convert voltage signals into digital data, and thus, uses an integrated circuit to convert a characteristic current of a pixel into a voltage signal usable in the analog-digital converting circuit. An integrated circuit may comprise an operational amplifier and an integral capacitor. Characteristic currents transferred from pixels through sensing lines are accumulated in the integral capacitor to form voltage signals.

However, in such a configuration, parasitic resistances and parasitic capacitances formed in the sensing lines may cause a deterioration of performance of an integrated circuit. A pixel and an integrated circuit are connected through a sensing line and a sensing line has a parasitic resistance of its own depending on the width and length of the line and forms a parasitic capacitance with surrounding electrodes. Such parasitic resistances and parasitic capacitances in sensing lines are perceived as load by an integrated circuit and this causes a so-called loading effect. A loading effect causes a decrease in the accuracy of an integrated circuit.

SUMMARY

An aspect of the present disclosure is to provide a technology for improving performance of a pixel sensing device. Another aspect of the present disclosure is to provide a technology for enhancing the sensing accuracy of a pixel sensing device. Still another aspect of the present disclosure is to provide a technology for reducing a loading effect in sensing lines of a pixel sensing device.

To this end, in an aspect, the present disclosure provides a pixel sensing device comprising: an analog-front-end circuit comprising an amplifying circuit comprising an operational amplifier, which comprises a first input terminal, a second input terminal, and an output terminal, a first transistor connected with the output terminal and a second transistor forming a current mirror circuit with the first transistor, wherein the first input terminal is connected with a pixel and the output terminal, and an integrating circuit to integrate a current flowing into the second transistor; an analog-digital converting circuit to generate sensing data corresponding to an output voltage from the integrating circuit; and a data transmitting circuit to transmit the sensing data to an external device.

A current, flowing from the first input terminal to the output terminal, may flow into the first transistor.

The amplifying circuit may further comprise a third transistor, through which a current, to be outputted through the output terminal of the operational amplifier flows, and a fourth transistor forming a current mirror circuit with the third transistor. The integrating circuit may integrate a current flowing into the second transistor or into the fourth transistor.

The first transistor may be connected with a low bias voltage in its one side and with the output terminal in its other side. The second transistor may be connected with the low bias voltage in its one side and with a mirroring terminal in its other side. The integrating circuit may be connected with the mirroring terminal.

The first transistor and the second transistor may form an N:1 current mirror circuit (N is a positive real number) and a current flowing into the second transistor may have 1/N times the amount of a current flowing into the first transistor.

A reference voltage may be connected with the second input terminal and the reference voltage may be formed in the first input terminal by the operational amplifier.

The integrating circuit may comprise another operational amplifier. One input terminal of this operational amplifier may be connected with the second transistor and the other input terminal thereof may be connected with a reference voltage. Between the one input terminal and an output terminal of this operational amplifier, an integrating capacitor may be disposed.

The pixel sensing device may further comprise a sample and hold circuit to temporarily store a voltage outputted from the integrating circuit and another amplifying circuit to amplify a signal outputted from the sample and hold circuit and to transfer the amplified signal to the analog-digital converting circuit.

In another aspect, the present disclosure provides a panel driving device for driving a panel on which a plurality of pixels are disposed and a plurality of data lines and a plurality of sensing lines, connected respectively with the plurality of pixels, are disposed, comprising: a data driving circuit to convert image data into a data voltage and to supply the data voltage through a data line; a pixel sensing circuit to generate sensing data corresponding to an integrated voltage of a characteristic current transferred from a pixel; and a data processing circuit to compensate the image data using the sensing data, wherein, in the pixel sensing circuit, the characteristic current is inputted inside an operational amplifier through its output terminal and the integrated voltage is formed by integrating a current of a second transistor forming a current mirror circuit with a first transistor disposed inside the operational amplifier in which the characteristic current flows.

The first transistor and the second transistor may form a N:1 (N is a positive real number) current mirror circuit and a current flowing into the second transistor may have 1/N times the amount of a current flowing into the first transistor.

An integrating circuit to integrate the current of the second transistor may comprise another operational amplifier.

The pixel sensing circuit may comprise a sample and hold circuit to temporarily store an integrated voltage, an amplifying circuit to amplify a signal outputted from the sample and hold circuit, and an analog-digital converting circuit to convert an outputted signal from the amplifying circuit into sensing data.

A pixel may comprise an organic light emitting diode (OLED).

The pixel sensing circuit may be connected with a contact node between a driving transistor to supply a driving current to the organic light emitting diode and the organic light emitting diode and receive a current flowing into the driving transistor or a current flowing into the organic light emitting diode as a characteristic current.

A characteristic of the driving transistor may be compensated using the image data according to the characteristic current.

As described above, the present disclosure allows reduction of a loading effect of a sensing line of a pixel sensing device, enhancing the sensing accuracy of a pixel sensing device, and improving the performance of a pixel sensing device.

DETAILED DESCRIPTION

Figure 1:
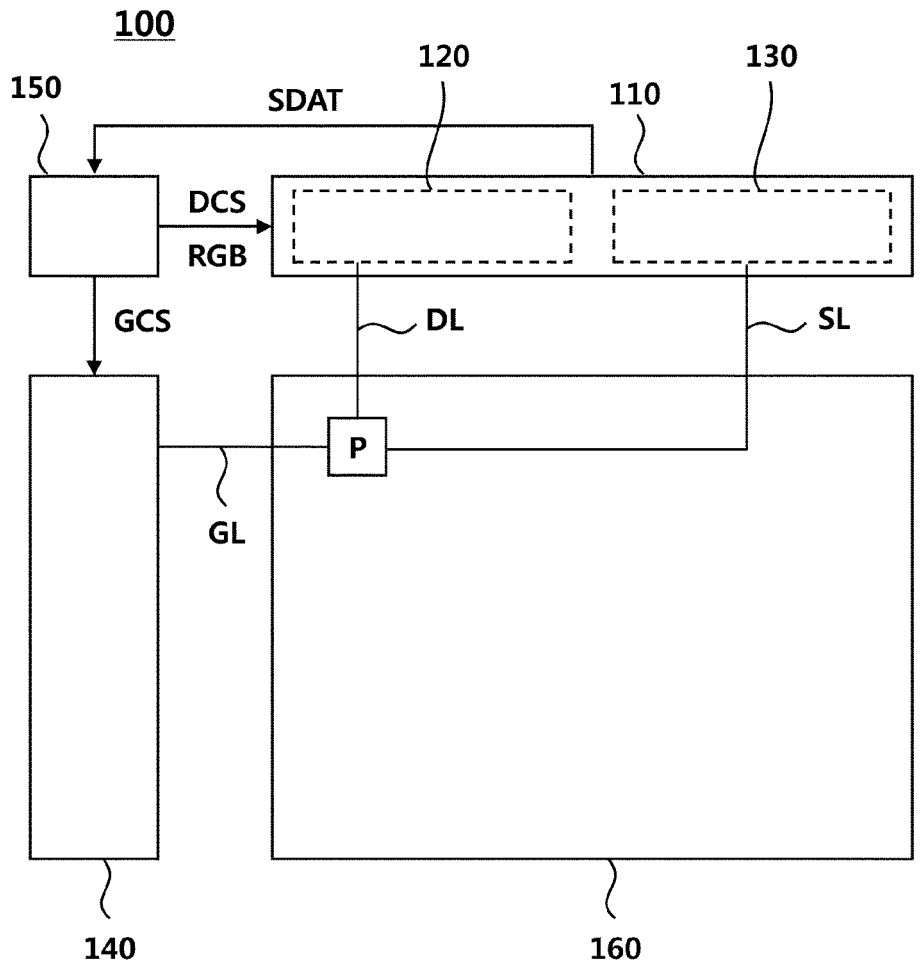
FIG. 1 is a configuration diagram of a display device according to an embodiment.

FIG. 1 is a configuration diagram of a display device according to an embodiment.

Referring to FIG. 1, a display device 100 may comprise a panel 160 and panel driving devices 120, 130, 140, 150 for driving the panel 160.

On the panel 160, a plurality of data lines DL, a plurality of gate lines GL, and a plurality of sensing lines SL may be disposed, and a plurality of pixels P may be disposed.

Panel driving devices may comprise a data driving circuit 120, a sensing circuit 130, a gate driving circuit 140, and a data processing circuit 150.

The gate driving circuit 140 may supply scan signals, such as turn-on voltages or turn-off voltages, through gate lines GL. When a scan signal of a turn-on voltage is supplied to a pixel P, this pixel P is connected with a data line DL, whereas, when a scan signal of a turn-off voltage is supplied to a pixel, this pixel is disconnected from the data line DL.

The data driving circuit 120 supplies data voltages to data lines DL. Data voltages supplied to data lines DL are transferred to pixels P connected with the data lines DL according to scan signals.

The sensing circuit 130 receives sensing signals, such as voltages, currents, or the like, formed in respective pixels P. The sensing circuit 130 may be connected with each pixel P according to a scan signal or according to a sensing scan signal. Here, a sensing scan signal may be generated by the gate driving circuit 140.

The data processing circuit 150 may supply various control signals to the gate driving circuit 140 and the data driving circuit 120. The data processing circuit 150 may generate gate control signals GCS to initiate a scan according to a timing implemented in each frame and transmit the gate control signals to the gate driving circuit 140. The data processing circuit 150 may convert image data inputted from outside into image data RGB in a format suitable for data signals used in the data driving circuit 120 and output the converted image data RGB to the data driving circuit 120. In addition, the data processing circuit 150 may transmit a data control signal DCS to control the data driving circuit 120 to supply a data voltage to each pixel P at an appropriate timing The data processing circuit 150 may compensate image data RGB depending on a characteristic of a pixel P and transmit compensated image data. For this, the data processing circuit 150 may receive sensing data SDAT from the sensing circuit 130. Sensing data SDAT may include a measured value for a characteristic of a pixel P.

Meanwhile, a data driving circuit 120 may be referred to as a source driver, a gate driving circuit 140 may be referred to as a gate driver, and a data processing circuit 150 may be referred to as a timing controller. A data driving circuit 120 and a sensing circuit 130 may be comprised in an integrated circuit 110 and referred to as a source driver integrated circuit (IC) or as a pixel sensing device. Otherwise, a data driving circuit 120, a sensing circuit 130, and a data processing circuit 150 may be comprised in an integrated circuit and referred to as a combined IC. Although the present disclosure is not limited to this, descriptions about some generally known components of a source driver, a gate driver, or a timing controller will be omitted in the description of embodiments below. Accordingly, the description of embodiments should be understood considering the fact that the description of such some components are omitted.

A panel 160 may be an organic light emitting display panel. In this case, each pixel P disposed on the panel 160 may comprise an organic light emitting diode (OLED) and at least one transistor. Characteristics of an organic light emitting diode OLED and at least one transistor comprised in each pixel P may vary depending on time or the pixel's surrounding environments. A sensing circuit 130 according to an embodiment may sense characteristics of such elements comprised in each pixel P and transmit them to a data processing circuit 150.

Figure 2:
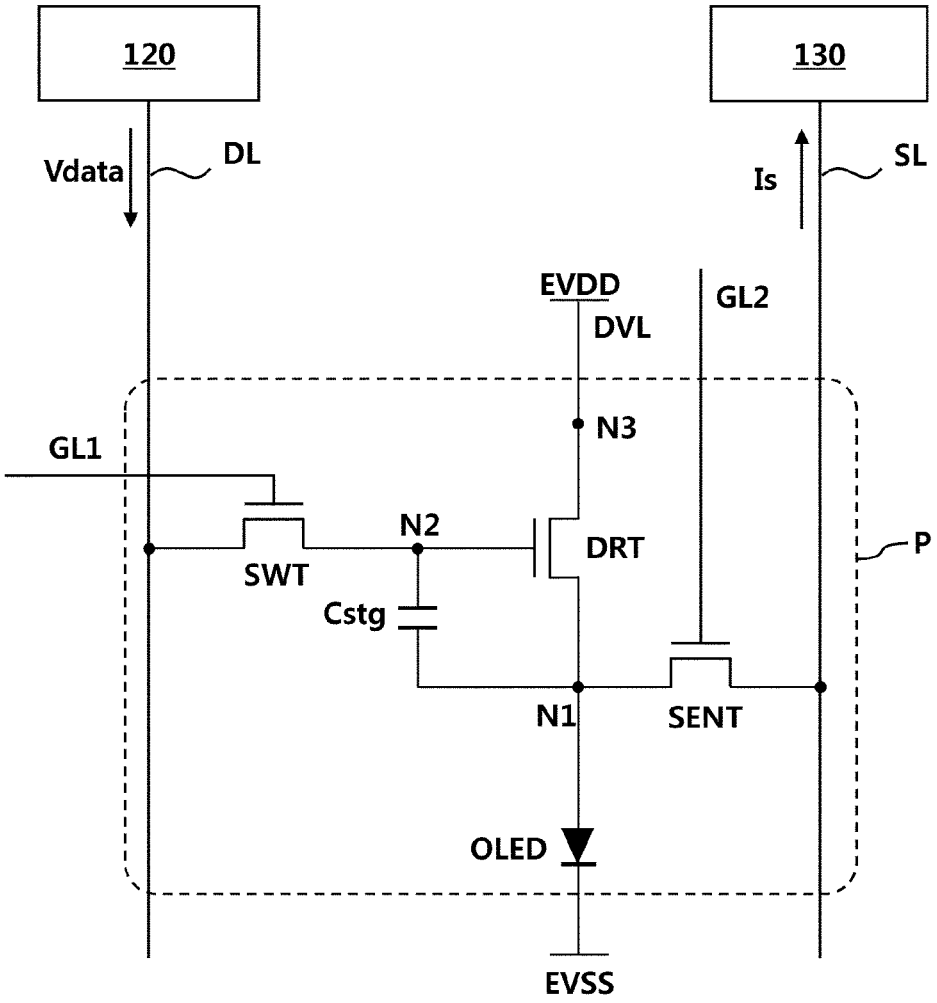
FIG. 2 is a diagram illustrating a structure of each pixel of FIG. 1 and signals outputted from and/or inputted into a data driving circuit, a pixel, and a sensing circuit according to an embodiment.

FIG. 2 is a diagram illustrating a structure of each pixel of FIG. 1 and signals outputted from and/or inputted into a data driving circuit, a pixel, and a sensing circuit.

Referring to FIG. 2, a pixel P may comprise a light emitting diode OLED, a driving transistor DRT, a switching transistor SWT, a sensing transistor SENT, and a storage capacitor Cstg.

An organic light emitting diode OLED may comprise an anode electrode, an organic layer, and a cathode electrode. According to a control of the driving transistor DRT, the anode electrode is connected in a direction of a driving voltage EVDD and the cathode electrode is connected with a base voltage EVSS, whereby the organic light emitting diode emits light.

The driving transistor DRT may control the brightness of the organic light emitting diode OLED by controlling a driving current supplied to the organic light emitting diode OLED.

A first node N1 of the driving transistor DRT may be electrically connected with the anode electrode of the light emitting diode OLED and may be a source node or a drain node. A second node N2 of the driving transistor DRT may be electrically connected with a source node or a drain node of the switching transistor SWT and may be a gate node. A third node N3 of the driving transistor DRT may be electrically connected with a driving voltage line DVL for supplying driving voltages EVDD and may be a drain node or a source node.

The switching transistor SWT may be electrically connected between the data line DL and the second node N2 of the driving transistor DRT and turned on by being provided with a scan signal through a first gate line GL1.

When the switching transistor SWT is turned on, a data voltage Vdata, supplied from the data driving circuit 120 through the data line DL, is transferred to the second node N2 of the driving transistor DRT.

The storage capacitor Cstg may be electrically connected between the first node N1 and the second node N2 of the driving transistor DRT.

The storage capacitor Cstg may be a parasitic capacitor that exists between the first node N1 and the second node N2 or an external capacitor that is intentionally disposed outside the driving transistor DRT.

The sensing transistor SENT may connect the first node N1 of the driving transistor DRT and a sensing line SL and, through the sensing line SL, a reference voltage may be transferred to the first node N1 and a value of a characteristic, such as a voltage or a current Is, of the first node N1 may be transferred to the sensing circuit 130.

The sensing circuit 130 measures a characteristic of a pixel P using a sensing signal Is transferred through the sensing line SL.

A sensing signal Is, which is a characteristic current indicating a characteristic of a pixel, may be a current flowing in the driving transistor DRT or in the organic light emitting diode OLED. The sensing circuit 130 may measure such a characteristic current and transmit a measured value to the data processing circuit (see 150 in FIG. 1). The data processing circuit (see 150 in FIG. 1) may analyze the measured value of the characteristic current to identify a characteristic of each pixel P.

A characteristic of each pixel P may be a threshold voltage or the mobility of a driving transistor DRT.

Figure 3:
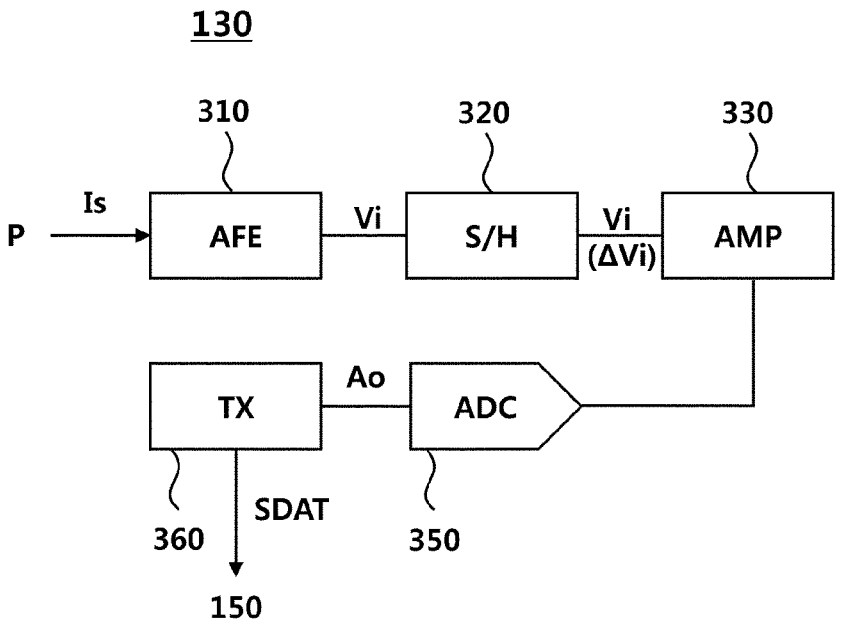
FIG. 3 is a configuration diagram of a sensing circuit according to an embodiment.

FIG. 3 is a configuration diagram of a sensing circuit according to an embodiment.

Referring to FIG. 3, the sensing circuit 130 may comprise an analog-front-end circuit (AFE) 310, a sample and hold circuit (S/H) 320, an amplifying circuit (AMP) 330, an analog-digital converting circuit (ADC) 350, and a data transmitting circuit (TX) 360.

The analog-front-end circuit 310 may sense a pixel P and form a sensing voltage Vi by processing a current Is transmitted from the pixel P. Depending on embodiments, the sensing voltage Vi may be the same as a voltage obtained by integrating the current Is transmitted from the pixel P. The analog-front-end circuit 310 may transmit the sensing voltage Vi to the amplifying circuit 330 and the amplifying circuit 330 may amplify the sensing voltage Vi or a difference ΔVi between the sensing voltage Vi and a reference voltage and transmit an amplified one to the analog-digital converting circuit 350.

Between the analog-front-end circuit 310 and the amplifying circuit 330, the sample and hold circuit 320 may be disposed. The sample and hold circuit 320 may separate the analog-front-end circuit 310 from the amplifying circuit 330 in terms of signal, temporarily store a sensing voltage Vi outputted from the analog-front-end circuit 310, and input the sensing voltage Vi or a difference ΔVi between the sensing voltage Vi and a reference voltage into the amplifying circuit 330.

The amplifying circuit 330 may amplify the sensing voltage Vi or the difference ΔVi between the sensing voltage Vi and the reference voltage transmitted through an input terminal, and then, transmit an amplified one to the analog-digital converting circuit 350. The analog-digital converting circuit 350 may convert a voltage outputted from the amplifying circuit 330 into a digital signal Ao.

The data transmitting circuit 360 may generate sensing data SDAT by processing the digital signals Ao collected from a plurality of channels and transmit the sensing data SDAT to an external device (for example, a data processing circuit 150).

Figure 4:
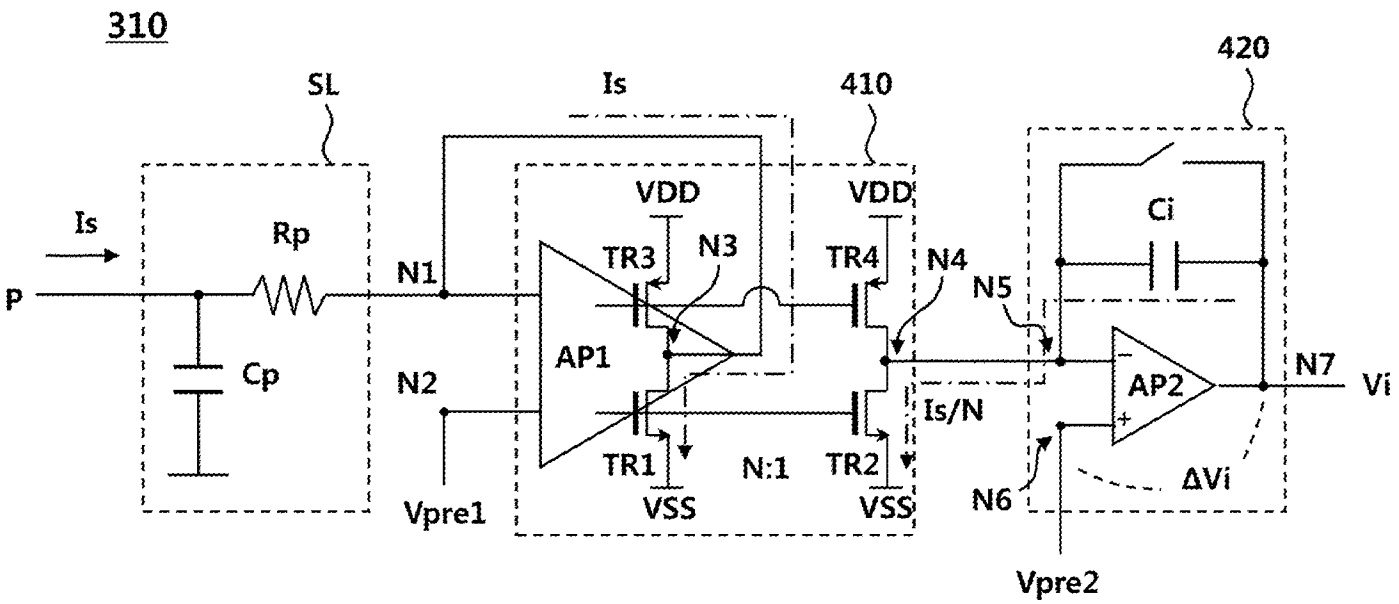
FIG. 4 is a configuration diagram of an analog-front-end circuit according to an embodiment.

FIG. 4 is a configuration diagram of an analog-front-end circuit according to an embodiment.

Referring to FIG. 4, the analog-front-end circuit 310 may comprise an amplifying circuit 410 and an integrating circuit 420.

The analog-front-end circuit 310 may receive a characteristic current Is from a pixel P through a sensing line SL. In the sensing line SL, a parasitic resistance Rp and a parasitic capacitance Cp may exist. The analog-front-end circuit 310 may reduce a loading effect of the sensing line SL for the integrating circuit 420 by separating the integrating circuit 420 from the pixel P using the amplifying circuit 410.

The amplifying circuit 410 may comprise a first operational amplifier AP1.

The first operational amplifier AP1 may comprise a first input terminal, a second input terminal, and an output terminal. The first input terminal may be connected with a first node N1 and a sensing line SL connected with a pixel P may be connected with the first node N1. The second input terminal may be connected with a second node N2 and a first reference voltage Vpre1 may be supplied through the second node N2. The output terminal may be connected with a third node N3 and the first node N1 may be connected with the third node N3. In a feedback structure in which the first input terminal and the output terminal are connected, a voltage of the second input terminal may be substantially identical to a voltage of the first input terminal because of a very great amplification gain of the operational amplifier. Accordingly, when the first reference voltage Vpre1 is supplied through the second input terminal, the first reference voltage Vpre1 may be formed in the first input terminal and the sensing line SL may be initialized or maintained to have the first reference voltage Vpre1.

The first operational amplifier AP1 may be driven by being provided with a high bias voltage VDD and a low bias voltage VSS as bias voltages.

To the output terminal of the first operational amplifier AP1, two transistors TR1, TR3 may be internally connected. The amplifying circuit 410 may further comprise another two transistors TR2, TR4 respectively formed current mirror circuits with the two transistors TR1, TR3.

Among the two transistors TR1, TR3 connected to the output terminal of the first operational amplifier AP1, a first transistor TR1 may offer a path through which a current inputted through the output terminal flows out to the low bias voltage VSS. A third transistor TR3 may offer a path through which a current outputted through the output terminal flows out from the high bias voltage VDD.

The second transistor TR2 may form a current mirror circuit with the first transistor TR1. The second transistor TR2 and the first transistor TR1 may respectively have gates connected with each other and both may be an N-typed transistor being connected with the low bias voltage VSS. Because of such a structure, a current, having a level proportional or identical to that of a current flowing into the first transistor TR1, may flow into the second transistor TR2.

A fourth transistor TR4 may form a current mirror circuit with the third transistor TR3. The fourth transistor TR4 and the third transistor TR3 may respectively have gates connected with each other and both may be a P-typed transistor being connected with the high bias voltage VDD. Because of such a structure, a current, having a level proportional or identical to that of a current flowing into the third transistor TR3, may flow into the fourth transistor TR4.

A characteristic current Is transferred from a pixel P may be transferred to the first node N1 via the sensing line SL. Since the internal impedance of the first operational amplifier AP1 is very high, the current transferred to the first node N1 may flow to the output terminal of the first operational amplifier, not to the first input terminal thereof. When a characteristic current Is has a positive level, the characteristic current Is may flow from the output terminal via the first transistor TR1 out to the low bias voltage VSS. When a characteristic current IS has a negative level (for example, when the current flows out toward the pixel P), the characteristic current Is may flow from the high bias voltage VDD, via the third transistor TR3, and out through the output terminal.

The integrating circuit 420 may integrate a current flowing to the second transistor TR2 or to the fourth transistor TR4.

The second transistor TR2 may be connected with the low bias voltage VSS in its one side and with the fourth node N4, which is a mirroring terminal, in its other side. The fourth transistor TR4 may be connected with the high bias voltage VDD in its one side and with the fourth node N4, which is a mirroring terminal, in its other side.

The integrating circuit 420 may be connected with the mirroring terminal (the fourth node N4) of the amplifying circuit 410, not with the output terminal thereof. The integrating circuit 420 may integrate a current formed in the mirroring terminal (the fourth node N4). Since a current formed in the mirroring terminal has a level proportional or identical to that of a current formed in the output terminal, the integrating circuit 420 may generate an integrated voltage for a characteristic current Is as a sensing voltage Vi. However, since the pixel P is connected only with the output terminal of the first operational amplifier AP1 and separated from the mirroring terminal, the integrating circuit 420 would hardly be affected by the sensing line SL.

The integrating circuit 420 may comprise a second operational amplifier AP2 and further comprise an integrating capacitor Ci disposed between a first input terminal and an output terminal of the second operational amplifier AP2. The first input terminal of the second operational amplifier AP2 may be connected with a fifth node N5 and the fifth node N5 may be connected with the fourth node N4, which is a mirroring terminal of the fifth node N5.

To a sixth node N6 connected with a second input terminal of the second operational amplifier AP2, a second reference voltage Vpre2 may be connected. Since the second operational amplifier AP2 has a very high amplification gain, voltages formed in the second input terminal and in the first input terminal may be substantially identical and, when the second reference voltage Vpre2 is supplied to the sixth node N6, the fifth node N5 may maintain the second reference voltage Vpre2 as its voltage. Accordingly, a voltage formed in the third node N3 and a voltage formed in the fourth node N4 may be identical. Here, the second reference voltage Vpre2 may have the same voltage level as that of the first reference voltage Vpre1 or they may have different levels.

The integrating capacitor Ci may be connected with the fifth node N5 in its one side and with a seventh node in its other side. The output terminal of the second operational amplifier AP2 may be connected with the seventh node N7.

A current flowing into the second transistor TR2 or into the fourth transistor TR4 may increase a voltage of the integrating capacitor Ci while flowing along a path passing the fifth node N5, the integrating capacitor Ci, and the seventh node N7. A voltage formed in the seventh node N7 according to a voltage of the integrating capacitor Ci may be transferred to the sample and hold circuit or the analog-digital converting circuit.

The first transistor TR1 and the second transistor TR2 may form a N:1 current mirror circuit (N is a positive real number). Accordingly, a current flowing into the second transistor TR2 may have 1/N times the amount of a current flowing into the first transistor TR1.

The third transistor TR3 and the fourth transistor TR4 may form a N:1 current mirror circuit (N is a positive real number). Accordingly, a current flowing into the fourth transistor TR4 may be 1/N times the level of a current flowing into the third transistor TR3.

When the amount of a current flowing into the second transistor TR2 or into the fourth transistor TR4 decreases, the amount of a current flowing into the integrating capacitor Ci may also decrease. Accordingly, the capacity of the integrating capacitor Ci may be set to be small.

Figure 5:
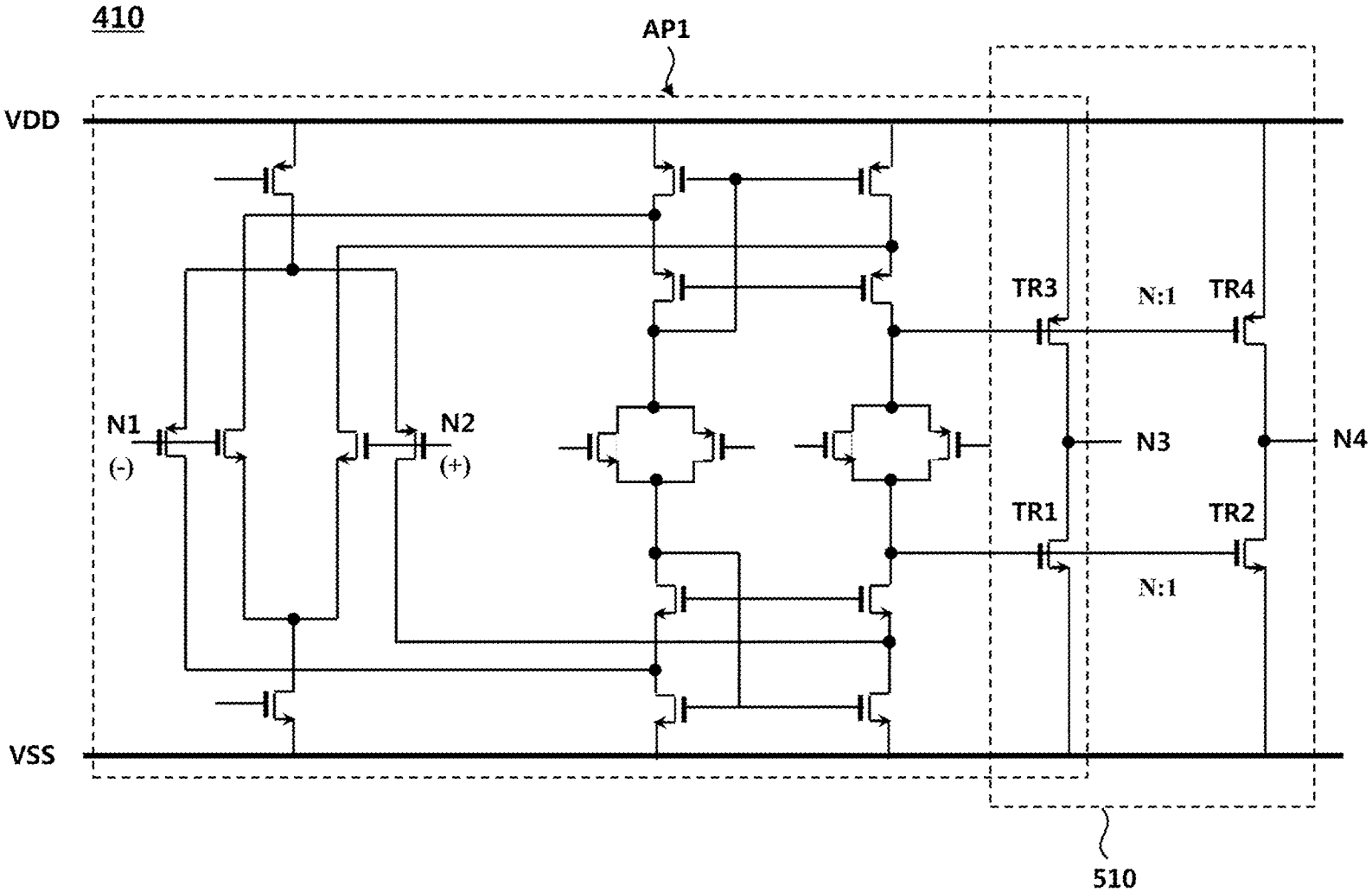
FIG. 5 is a diagram illustrating a configuration inside an amplifying circuit according to an embodiment.

FIG. 5 is a diagram illustrating a configuration inside an amplifying circuit.

Referring to FIG. 5, in the amplifying circuit 410, the first operational amplifier AP1 may be formed using a plurality of transistors.

The first transistor TR1 and the third transistor TR3 may be connected to the output terminal of the first operational amplifier AP1 connected with the third node N3. The second transistor TR2 sharing a gate voltage with the first transistor TR1 may be disposed between the fourth node N4 and the low bias voltage VSS, and the fourth transistor TR4 sharing a gate voltage with the third transistor TR3 may be disposed between the fourth node N4 and the high bias voltage VDD.

Because of such a structure, the amplifying circuit 410 may output a current, having a level proportional or identical to that of a characteristic current of a pixel inputted or outputted through the third node N3, through the fourth node N4 which is separated from the third node N3.

Figure 6:
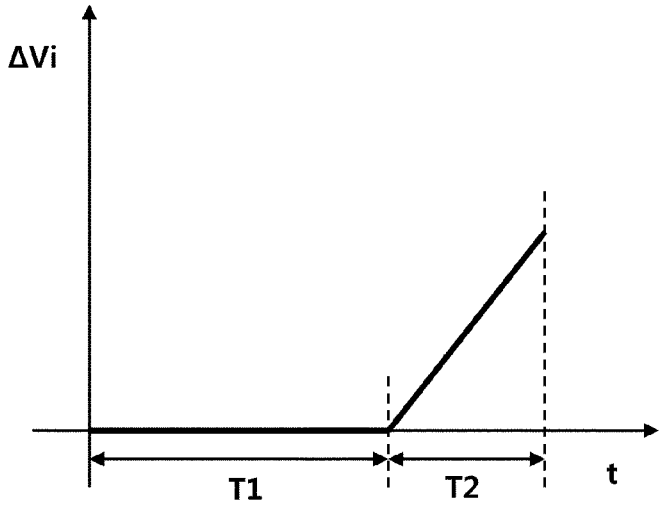
FIG. 6 is a graph illustrating a change over time of a delta voltage corresponding to a difference between a sensing voltage and a reference voltage of FIG. 4 according to an embodiment.

FIG. 6 is a graph illustrating a change over time of a delta voltage corresponding to a difference between a sensing voltage and a reference voltage of FIG. 4.

Referring to FIG. 4 and FIG. 6, the analog-front-end circuit 310 may operate differently in a standby time section T1 and in an integrating time section T2. The analog-front-end circuit 310 does not receive a characteristic current Is in the standby time section T1. Accordingly, no current flows in the integrating capacitor Ci and voltages of both ends of the integrating capacitor Ci may be identical. A delta voltage ΔVi, corresponding to a difference between a sensing voltage Vi and a second reference voltage Vpre2, may be identical to the voltages of the both ends of the integrating capacitor Ci. Accordingly, a delta voltage ΔVi in the standby time section T1 may be 0.

In the integrating time section T2, the analog-front-end circuit 310 may receive a characteristic current Is from a pixel P. Here, in the integrating capacitor Ci, a current, having 1/N times the level of the characteristic current Is, flows from the seventh node N7 toward the fifth node N5, the voltages of the both ends of the integrating capacitor Ci, that is, the delta voltage ΔVi may increase in a positive direction. The delta voltage ΔVi and the characteristic current Is may have a relation represented by equation 1.

$$\Delta Vi(t)=(Is/N)\cdot t \text{ (}t\text{ is time)} \qquad \text{[Equation 1]}$$

The analog-front-end circuit 310 may integrate the integrating capacitor Ci with a current having 1/N times the level of the characteristic current Is, and output the relevant voltage as a sensing voltage Vi.

The sample and hold circuit, the amplifying circuit, and the analog-digital converting circuit may generate a digital signal corresponding to the sensing voltage Vi, and the data transmitting circuit may collect digital signals from the respective channels, generate sensing data, and transmit the sensing data to the data processing circuit.

The data processing circuit may compensate image data using the sensing data and transmit the compensated image data to the data driving circuit. The data driving circuit may display an image on the panel using the compensated image data.

According to the present disclosure, a loading effect of a sensing line of a pixel sensing device may be reduced, the sensing accuracy of the pixel sensing device may be enhanced, and the performance of the pixel sensing device may be improved.

What is claimed is:

1. A pixel sensing device comprising:

an analog-front-end circuit comprising an amplifying circuit including an operational amplifier in which a first input terminal, a second input terminal, and an output terminal are formed, a first transistor connected with the output terminal of the operational amplifier, and a second transistor forming a current mirror circuit with the first transistor, wherein the first input terminal is connected with a pixel through a sensing line and the output terminal, and an integrating circuit for integrating a current flowing into the second transistor;

an analog-digital converting circuit to generate sensing data corresponding to a voltage output from the integrating circuit; and a data transmitting circuit to transmit the sensing data to an external device, wherein a first reference voltage is connected to the second input terminal, and the first reference voltage is formed in the first input terminal by the operational amplifier, and the sensing line is initiated to have the first reference voltage.

2. The pixel sensing device of claim 1, wherein a current, flowing from the first input terminal to the output terminal, flows into the first transistor.

3. The pixel sensing device of claim 1, wherein the amplifying circuit further comprises a third transistor through which a current, outputted through the output terminal of the operational amplifier, flows and a fourth transistor forming a current mirror circuit with the third transistor, and the integrating circuit integrates a current flowing into the second transistor or into the fourth transistor.

4. The pixel sensing device of claim 1, wherein the first transistor is connected with a low bias voltage in its one side and with the output terminal in its other side, the second transistor is connected with the low bias voltage in its one side and with a mirroring terminal in its other side, and the integrating circuit is connected with the mirroring terminal.

5. The pixel sensing device of claim 1, wherein the first transistor and the second transistor form an N:1 current mirror circuit (N is a positive real number), and a current flowing into the second transistor has 1/N times a level of a current flowing into the first transistor.

6. The pixel sensing device of claim 1, wherein the integrating circuit comprises another operational amplifier, wherein this operational amplifier is connected with the second transistor in its one input terminal and with a second reference voltage in its other input terminal, and an integrating capacitor is disposed between the one input terminal and the other input terminal of this operational amplifier, wherein the second reference voltage has a same voltage level as that of the first reference voltage.

7. The pixel sensing device of claim 1, further comprising a sample and hold circuit to temporarily store a voltage outputted from the integrating circuit and another amplifying circuit to amplify a voltage outputted from the sample and hold circuit and to transmit the amplified voltage to the analog-digital converting circuit.

8. A panel driving device for driving a panel on which a plurality of pixels are disposed and a plurality of data lines and a plurality of sensing lines are disposed, comprising:

a data driving circuit to convert image data into a data voltage and to supply the data voltage through a data line;

a pixel sensing circuit to generate sensing data corresponding to an integrated voltage of a characteristic current transferred from a pixel; and a data processing circuit to compensate the image data using the sensing data, wherein, in the pixel sensing circuit, the characteristic current is inputted through an output terminal of an operational amplifier, and the integrated voltage is formed by integrating a current of a second transistor disposed inside the operational amplifier, forming a current mirror circuit with a first transistor therein, wherein a first input terminal, a second input terminal, and the output terminal are formed in the operational amplifier, and the first input terminal is connected with the pixel through a sensing line and the output terminal, wherein a first reference voltage is connected to the second input terminal, and the first reference voltage is formed in the first input terminal by the operational amplifier, and the sensing line is initiated to have the first reference voltage.

9. The panel driving device of claim 8, wherein the first transistor and the second transistor form a N:1 (N is a positive real number) current mirror circuit and a current flowing into the second transistor has 1/N times a level of a current flowing into the first transistor.

10. The panel driving device of claim 8, wherein an integrating circuit to integrate a current of the second transistor comprises another operational amplifier.

11. The panel driving device of claim 8, wherein the pixel sensing circuit a sample and hold circuit to temporarily store an integrated voltage, an amplifying circuit to amplify a signal outputted from the sample and hold circuit, and an analog-digital converting circuit to convert an outputted signal from the amplifying circuit into sensing data.

12. The panel driving device of claim 8, wherein a pixel comprises an organic light emitting diode.

13. The panel driving device of claim 12, wherein the pixel sensing circuit is connected with a contact node between a driving transistor to supply a driving current to the organic light emitting diode and the organic light emitting diode and receives a current flowing into the driving transistor or a current flowing into the organic light emitting diode as a characteristic current.

14. The panel driving device of claim 13, a characteristic of the driving transistor is compensated according to the characteristic current.

* * * * *